US010414557B2

(12) United States Patent
Skillin et al.

(10) Patent No.: US 10,414,557 B2
(45) **Date of Patent: *Sep. 17, 2019**

(54) DROP DISPENSING CLOSURE

(71) Applicant: Silgan Dispensing Systems Slatersville LLC, Slatersville, RI (US)

(72) Inventors: Clifford W. Skillin, Blackstone, MA (US); Patrick J. Brannon, Warwick, RI (US); Sergey Romanov, Cranston, RI (US)

(73) Assignee: Silgan Dispensing Systems Slatersville LLC, Slatersville, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,323

(22) Filed: Dec. 20, 2017

(65) Prior Publication Data

US 2018/0111723 A1 Apr. 26, 2018

Related U.S. Application Data

(63) Continuation of application No. 15/262,624, filed on Sep. 12, 2016, now Pat. No. 9,884,706.

(51) Int. Cl.

| | |
|---|---|
| ***B65D 47/18*** | (2006.01) |
| ***B65D 41/34*** | (2006.01) |
| ***B65D 47/32*** | (2006.01) |
| ***B65D 47/40*** | (2006.01) |
| ***B65D 47/08*** | (2006.01) |

(52) U.S. Cl.

CPC ..... *B65D 47/18* (2013.01); *B65D 41/34* (2013.01); *B65D 47/0838* (2013.01); *B65D 47/32* (2013.01); *B65D 47/40* (2013.01); *B65D 2101/003* (2013.01); *B65D 2101/0023* (2013.01); *B65D 2547/063* (2013.01)

(58) Field of Classification Search

CPC .... B65D 47/18; B65D 47/0838; B65D 47/40; B65D 41/34; B65D 47/32; B65D 2101/003; B65D 2547/063; B65D 2101/0023

See application file for complete search history.

(56) References Cited

U.S. PATENT DOCUMENTS

| | | | | |
|---|---|---|---|---|
| 2,601,040 A * | 6/1952 | Livingstone | B65D 47/06 215/12.1 |
| 3,059,816 A * | 10/1962 | Goldstein | B65D 47/0842 215/235 |
| 3,168,221 A * | 2/1965 | Parker | B65D 47/06 222/109 |
| 4,193,519 A | 3/1980 | Dubach et al. | |
| 5,071,037 A | 12/1991 | Moore et al. | |

(Continued)

FOREIGN PATENT DOCUMENTS

| | | |
|---|---|---|
| DE | 2531690 A1 | 2/1977 |
| JP | 20050022673 | 1/2005 |

*Primary Examiner* — David P Angwin
*Assistant Examiner* — Bob Zadeh
(74) *Attorney, Agent, or Firm* — Barlow, Josephs & Holmes, Ltd.

(57) ABSTRACT

A one-piece dispensing closure for dispensing essential oils includes an integrally formed closure body, tubular dispensing spout, a hinged cap and a latch for maintaining the cap in an open position. The cap is connected to the closure body by a living hinge to allow the user to selectively open and close the container.

20 Claims, 16 Drawing Sheets

(56) References Cited

U.S. PATENT DOCUMENTS

| | | | | |
|---|---|---|---|---|
| 5,119,975 | A * | 6/1992 | Jemielita | B65D 47/18 222/420 |
| 5,141,138 | A * | 8/1992 | Odet | B65D 47/0814 215/235 |
| 5,221,017 | A | 6/1993 | Cistone et al. | |
| 5,289,950 | A | 3/1994 | Gentile | |
| 6,170,719 | B1 | 1/2001 | Wilkinson et al. | |
| 9,010,590 | B2 | 4/2015 | Kallenbach et al. | |
| 9,334,097 | B2 | 5/2016 | Skillin et al. | |
| 9,371,165 | B2 * | 6/2016 | Brannon | B65D 47/40 |
| 9,884,706 | B1 * | 2/2018 | Skillin | B65D 47/0838 |
| 2012/0074180 | A1 | 3/2012 | Kallenbach et al. | |
| 2013/0056501 | A1 | 3/2013 | Beilke et al. | |
| 2014/0252034 | A1 * | 9/2014 | Brannon | B65D 47/40 222/111 |
| 2015/0025506 | A1 | 1/2015 | Chau | |
| 2015/0048113 | A1 * | 2/2015 | Brannon | B65D 47/40 222/109 |
| 2015/0048124 | A1 | 2/2015 | Wisniewski | |
| 2015/0090743 | A1 | 4/2015 | Wisniewski et al. | |
| 2018/0111723 | A1 * | 4/2018 | Skillin | B65D 47/0838 |

* cited by examiner

DROP DISPENSING CLOSURE

CROSS-REFERENCE TO RELATED APPLICATIONS

This application is a continuation of U.S. application Ser. No. 15/262,624, filed Sep. 12, 2016.

BACKGROUND OF THE INVENTION (1) Field of the Invention

The instant invention relates to dispensing closures for containers and more specifically to a one-piece dispensing closure for precise dispensing of measured drops of essential oils or other fluids.

(2) Description of Related Art

Dispensing containers are used in a variety of industries for dispensing of various liquid products. For example, dispensing containers may be used for shampoo, lotion, condiments, beverages or oils. As integrated dispensing closures become more prevalent in all industries, consumers push for their use on an ever expanding array of products and packages, and product manufacturers push for unique solutions and reduced costs to promote sales.

SUMMARY OF THE INVENTION

A one-piece drop dispensing closure for precisely dispensing drops of essential oils or other fluids includes an integrally formed closure body, tamper evident skirt ring, hinged cap, tamper evident closure system, hermetic seals, an integrated drainback and venting system, and a latch back for maintaining the cap in an open position for clean dispensing. The present dispensing closure is particularly configured and arranged for molding as an integral one-piece structure to reduce manufacturing costs, but also for molding flexibility to adjust diameters of the dispensing orifice and vent opening as well as the length of a venting tube.

The closure body has a closure deck and a skirt portion extending downwardly from the closure deck with the skirt being configured and arranged to secure to a neck of a container. The container in the exemplary embodiment is a glass bottle for containing essential oils which are dispensed in small quantities for aromatic, topical or internal use. The bottle container includes a body portion and a neck. In the exemplary embodiments, the neck of the container is outwardly threaded while the inside surface of the closure skirt bring inwardly threaded for engagement.

A tamper-evident skirt ring is connected to a lower peripheral edge of the skirt portion by a plurality of frangible security elements. Removal of the closure from the bottle prior to purchase will sever the frangible elements clearly indicating tampering with the product.

A hinged cap is connected to the closure body via an integrally formed living hinge which provides for hinged movement of the cap between a closed position and an open position. The cap has an upper wall and an outer sidewall depending downwardly from the upper wall.

To provide a clean and neat pouring experience and to prevent product waste, the closure includes a drainback recess having a side wall depending downwardly from the closure deck into the interior of the closure. The drainback recess further has a bottom wall extending inwardly from the side wall. The outside surface of the side wall is received into the container neck and is contoured and sized for frictional sealing engagement with the inner surface of the container neck to provide a seal when the closure is threadably received on the container.

A vent tube depends downwardly from the bottom wall and the vent tube has a vent opening at a bottom end thereof. The vent tube has a predetermined length which can be adjusted in the molding process, along with the diameter of the vent opening to control drop size and frequency, but in no case does the vent tube length extend beyond a lower peripheral edge of the skirt ring. Restricting the vent tube length to within the height of the closure allows the closure to sit flat on the skirt ring during filling and capping and allows the manufacturer to continue to use existing capping machinery.

A tubular dispensing spout extends upwardly from the bottom wall of the drainback recess. The dispensing spout includes a drop dispensing orifice with a flow path through the spout configured to communicate with an interior of the container. The drop dispensing orifice also has a predetermined diameter which can be adjusted with the vent tube length and vent opening size to more precisely control drop size and frequency depending on the viscosity of the essential oil being dispensed.

The spout is provided with a drip lip having a leading edge and a trailing edge, the lip being downwardly angled from the leading edge thereof towards the trailing edge thereof, i.e. towards the rear side of the closure where the living hinge is formed for the cap. The bottom wall of the drainback recess is also downwardly sloped from the leading edge of the drip lip towards the trailing edge thereof, and the vent tube is located on the trailing edge side (downward slope side) of the drip lip. Excess oil is drawn down the outside of the spout into the drainback recess, and further down the angled bottom wall of the drainback recess into the vent tube and eventually down through the vent opening into the interior of the container. Accordingly, it is noted that the vent opening also functions as the drainback opening into the interior of the container. The leading edge of the drip lip has an acute edge angle of less than 45 degrees to provide a clean drop cut off to minimize drainback.

To provide a hermetic seal between the closure body and cap, an annular sealing lip extends upwardly from the closure deck encircling the drain back recess while the cap includes concentrically spaced annular sealing walls depending downwardly from the upper wall. The annular sealing lip includes a sealing bead at the upper peripheral edge which extends both radially inward and outward. The concentric annular sealing walls respectively include sealing beads extending toward the sealing lip. When the cap is in the closed position, the annular sealing walls engage with the annular sealing lip to form a dual hermetic seal on both the outside and inside of the sealing lip. The hermetic seal preserves the quality of the product within the container and prevents evaporation over extended periods of storage between uses.

To further seal the container, the cap further includes a plug seal depending downwardly from the upper wall which concentrically engages with the spout to form another seal.

An arcuate tamper-evident tear strip is integrally formed with the closure deck where the tear strip is connected to the closure deck by a plurality of frangible elements extending between a lower edge of the tear strip and the closure deck. The tear strip is selectively detachable from the closure deck by breaking of the frangible elements. At least one locking tab is formed on an outer surface of the cap wherein the locking tab is positioned to engage a shoulder formed on a lower edge on the tear strip when the cap is in the closed position. In operation, the locking tab and the shoulder cooperate to prevent the cap from being moved from the closed position to the open position without detaching the tear strip from the closure deck. Premature lifting cap prior to purchase will sever the frangible elements clearly indicating tampering with the product.

To selectively maintain the cap in an open position during dispensing, a first flexible latch protrusion is provided on the upper wall of the cap above the living hinge, and a second flexible latch protrusion is provided on an outer surface of the closure body below the living hinge. The latch protrusions are configured to frictionally engage and maintain the cap in a fully open position.

Accordingly, exemplary embodiments of the invention may include a dispensing orifice, a vent opening and a vent tube which are variable in dimension to precisely control drop size and frequency depending on the viscosity of the essential oil being dispensed Embodiments of the invention may include a tamper-evident tear strip that prevents a user from opening a cap without at least partially detaching the tear strip from the cap.

Some embodiments of the invention may include dual hermetic seals surrounding the drainback recess and dispensing spout.

Some embodiments of the invention may include a plug seal with the bottle neck and/or a plug seal in or around the dispensing spout.

Other embodiments of the invention may further include an angled dispensing dip lip with an acutely angled drip edge.

Further embodiments of the invention may include a latch back mechanism that allows the user to secure the cap to the closure body when the cap is in an open state, so that the cap is out of the way of the dispensing orifice on the closure body.

While embodiments of the invention have been described as having the features recited, it is understood that various combinations of such features are also encompassed by particular embodiments of the invention and that the scope of the invention is limited by the claims and not the description.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 6:
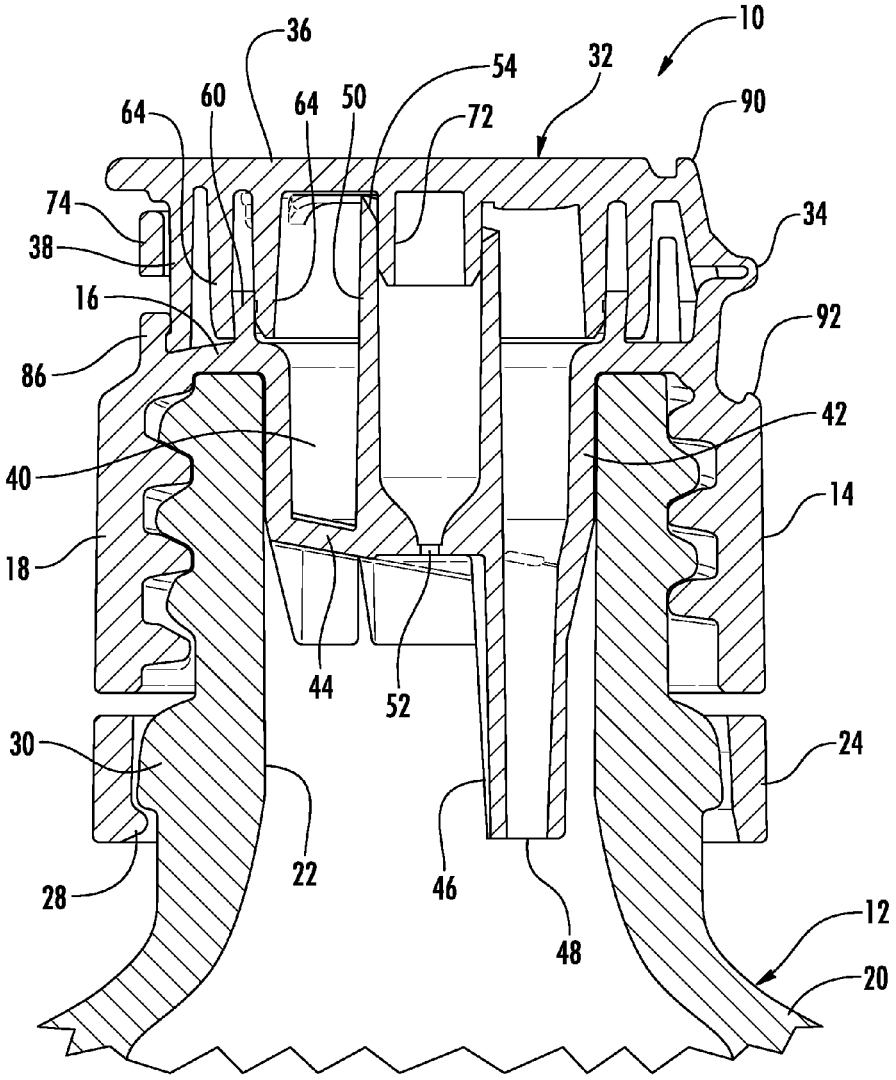
FIG. 6 is a cross-sectional view thereof taken along line 6-6 of FIG. 1.

Referring now to the drawings, a drop dispensing closure according to the exemplary embodiments of the instant invention is illustrated and generally indicated at 10 in FIGS. 1-10. As will hereinafter be more fully described, the instant drop dispensing closure 10 provides a one-piece dispensing closure for a bottle-like container 12 (FIG. 6). The one-piece drop dispensing closure 10 is effective for precisely dispensing measured drops of essential oils, or other fluids, which may have differing viscosities and potencies across a broad product range. An exemplary embodiment of the closure 10 includes an integrally formed closure body, a tamper evident skirt ring, a hinged cap, a tamper evident closure system, multiple hermetic seals, integrated drainback and venting systems, and a latch back for maintaining the cap in an open position for clean dispensing. The present dispensing closure 10 is particularly configured and arranged for molding as a one-piece entity to reduce manufacturing costs, but also for molding flexibility to easily adjust dimensions of a dispensing orifice and a venting opening, as well as the length of a venting tube.

The closure body 14 has a closure deck 16 and a skirt portion 18 extending downwardly from the closure deck 16 with the interior surface of the skirt 18 portion being configured and arranged to secure to an outside surface of the neck of the container 12. The container 12 in the exemplary embodiment is a bottle (glass or plastic) for containing essential oils which are dispensed in small measured quantities (drops) for aromatic, topical and/or internal use. The oils may have varying viscosities and potencies, and therefore there is a need to adjust the dispensing volume and rate of dispensing across different products. Generally, the bottle container 12 includes a body portion 20 and a neck 22 (See FIG. 6). The shape of the body portion 20 of the container 12 is not critical to the invention. In the exemplary embodiments, the neck 22 of the container 12 is outwardly threaded with the inside surface of the closure skirt 18 being inwardly threaded for engagement. Other types of containers 12 are contemplated within the scope of the disclosure and other types of arrangements for securing the closure 10 to the container 12 are also contemplated.

A tamper-evident skirt ring 24, if included, is connected to a lower peripheral edge of the skirt portion 18 by a plurality of frangible security elements 26. The skirt ring 24 includes an inwardly turned flange 28 at the lower edge thereof while the bottle neck 22 includes an external tapered ridge 30. Upon installing the closure 10 onto the bottle 12, the flange 28 will ride over the tapered ridge 30 and seat itself on the lower edge of the ridge 30. The arrangement allows the closure 10 to be threaded onto the bottle neck 22 without disturbing the skirt ring 24. However, unscrewing the closure 10 from the bottle 12 prior to purchase will sever the frangible elements 26 clearly indicating tampering with the product.

Figure 7:
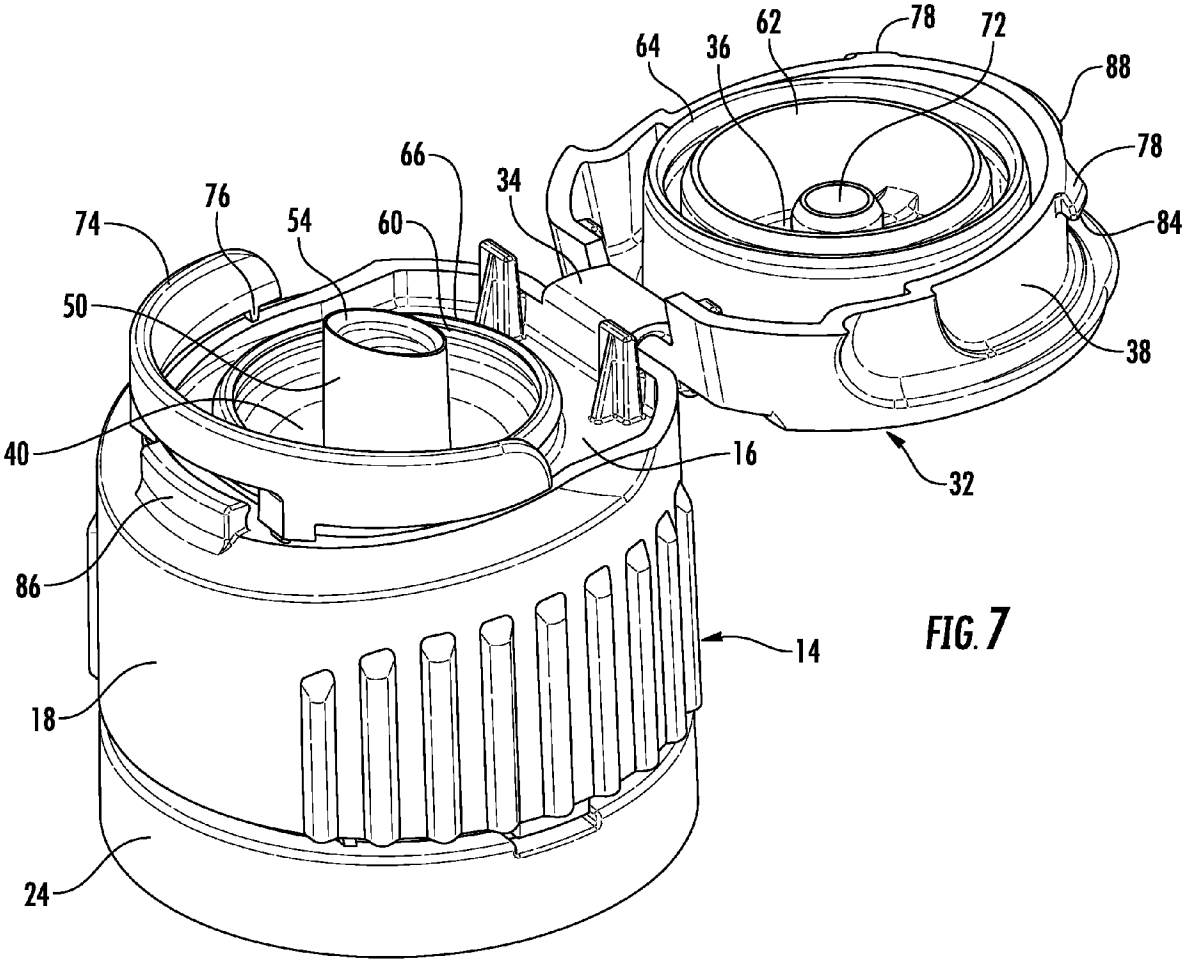
FIG. 7 is a perspective view thereof in an open, as-molded condition.
Figure 8:
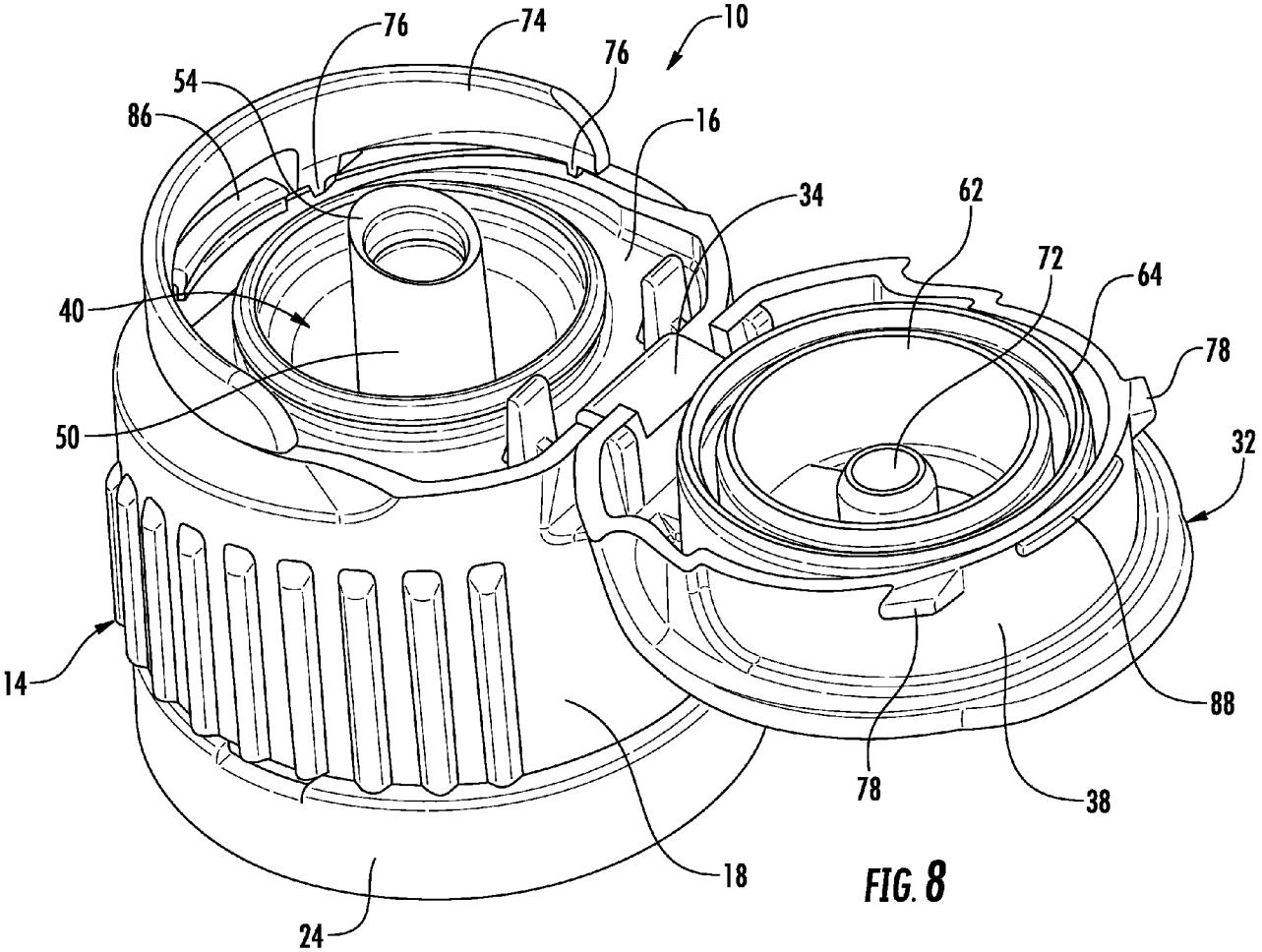
FIG. 8 is another perspective view thereof in an open, as-molded condition.
Figure 9:
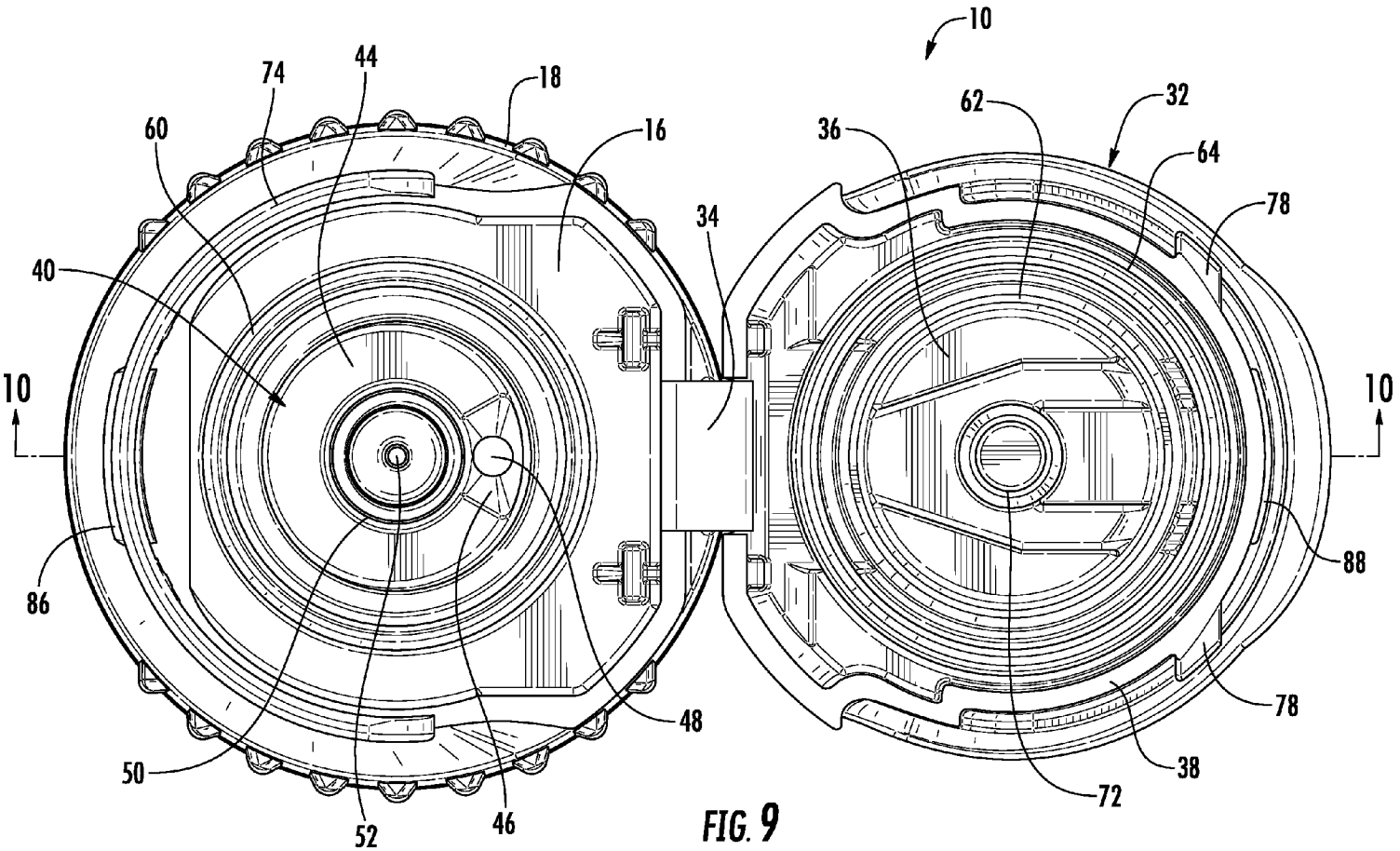
FIG. 9 is a top view thereof in an open, as-molded condition.

A hinged cap 32 is connected to the closure body 14 via an integrally formed living hinge 34 which provides for hinged movement of the cap 32 between a closed position (FIG. 1) and an open position (FIG. 7). The cap 32 has an upper wall 36 and an outer sidewall 38 depending downwardly from the upper wall 36.

To provide a clean and neat pouring experience and to prevent product waste, the closure 10 may include a drainback recess 40 (best illustrated in FIGS. 7, 8 and 10) having a side wall 42 depending downwardly from the closure deck 16 into the interior of the closure 10 and further having a bottom wall 44. The outside surface of the side wall 42 is received into the container neck 22 and is contoured and sized for frictional sealing engagement with the inner surface of the container neck 22 to provide a seal when the closure 10 is threadably received thereon (see FIG. 6).

A vent tube 46 depends downwardly from the bottom wall 44 and the vent tube 46 has a vent opening 48 at a bottom end thereof. The vent tube 46 has a predetermined length which can be adjusted in the molding process, along with the diameter of the vent opening 48 to control drop size and frequency, but in preferred embodiments the vent tube length does not extend beyond a lower peripheral edge of the skirt ring 24. Restricting the length of the vent tube 46 to within the height of the skirt wall 18 of the closure 10 allows the closure 10 to sit flat on the skirt ring 24 during filling and capping and allows the manufacturer to continue to use existing capping machinery. Nevertheless, embodiments with a longer vent tube are contemplated. Exemplary embodiments of the invention may be formed without the tamper evident skirt ring 24 (not shown) and in these embodiments, the preferred length of the vent tube 46 also does not extend below a lower peripheral edge of the skirt wall 24.

A tubular dispensing spout 50 extends upwardly from the bottom wall 44 of the drainback recess 40. The dispensing spout 50 includes a drop dispensing orifice 52 with a flow path through the spout 50 configured to communicate with an interior of the container 12. The drop dispensing orifice 52 also has a predetermined diameter and flow path length which can be adjusted, along with the length of the vent tube 46 and size of the vent opening 48, to more precisely control drop size and frequency depending on the viscosity of the essential oil or other fluid being dispensed. The orifice flow path length and diameter can be varied to provide a more restricted flow or a freer flow as the circumstances require. In the exemplary embodiments, the diameter of the dispensing orifice 52 is in a range from about 0.015 inch to about 0.035 inch, while the diameter of the vent opening 48 is in a range from about 0.040 inch to about 0.080 inch and the length of the vent tube 46 has a range from about 0.444 inch to about 0.864 inch. While there are provided certain ranges herein for the exemplary embodiments as these ranges have been found to be effective for dispensing of the noted essential oils, the invention has broader applicability to other fluids, and the disclosure should not be specifically limited to these ranges per se.

The spout 50 is provided with a drip lip 54 having a leading drip edge 56 and a trailing edge 58, the drip lip 54 being downwardly angled from the leading edge 56 towards the trailing edge 58, i.e. angled from the front towards the rear side of the closure 10 where the living hinge 34 is formed for the cap 32. The leading edge 56 of the drip lip 54 has an acute edge angle of less than 45 degrees to provide a clean drop cut off which minimizes drainback. The bottom wall 44 of the drainback recess 40 is also downwardly sloped from the leading edge 56 of the drip lip 54 towards the trailing edge 58, and the vent tube 46 is located on the trailing edge side (downward slope side) of the drip lip 54. Excess oil is drawn down the outside of the spout 50 into the drainback recess 40, and further down the angled bottom wall 44 of the drainback recess 40 into the vent tube 46 and eventually down through the vent opening 48 into the interior of the container 12. Accordingly, it is noted that the vent opening 48 also functions as the drainback opening into the interior of the container 12. The location of the vent tube 46 at the rear side of the closure 10 assists in allowing free venting air flow during dispensing of the product. It can be appreciated that when the bottle 12 is inverted and tipped to dispense the product, the vent tube 46 and vent opening 48 will be located above the oil level thereby providing a free path for air to enter the interior of the container 12 during dispensing.

To provide a hermetic seal between the closure body 14 and cap 32, an annular sealing lip 60 extends upwardly from the closure deck 16 encircling the drain back recess 40 while the cap 32 includes concentrically spaced annular sealing walls 62, 64 depending downwardly from the upper wall 36. The annular sealing lip 60 includes a sealing bead 66 at the upper peripheral edge which extends both radially inward and outward. The concentric annular sealing walls 62, 64 respectively include sealing beads 68, 70 extending toward the sealing lip 60. When the cap 32 is in the closed position (FIG. 6), the annular sealing walls 62, 64 engage with the annular sealing lip 60 to form a dual hermetic seal on both the outside and inside of the sealing lip 60. The hermetic seal preserves the quality of the product within the container 12 and prevents evaporation over extended periods of storage between uses.

To further seal the container 12, the cap 32 further includes a plug seal 72 depending downwardly from the upper wall 36 which concentrically engages with the interior of the spout 50 to form another seal.

Figure 1:
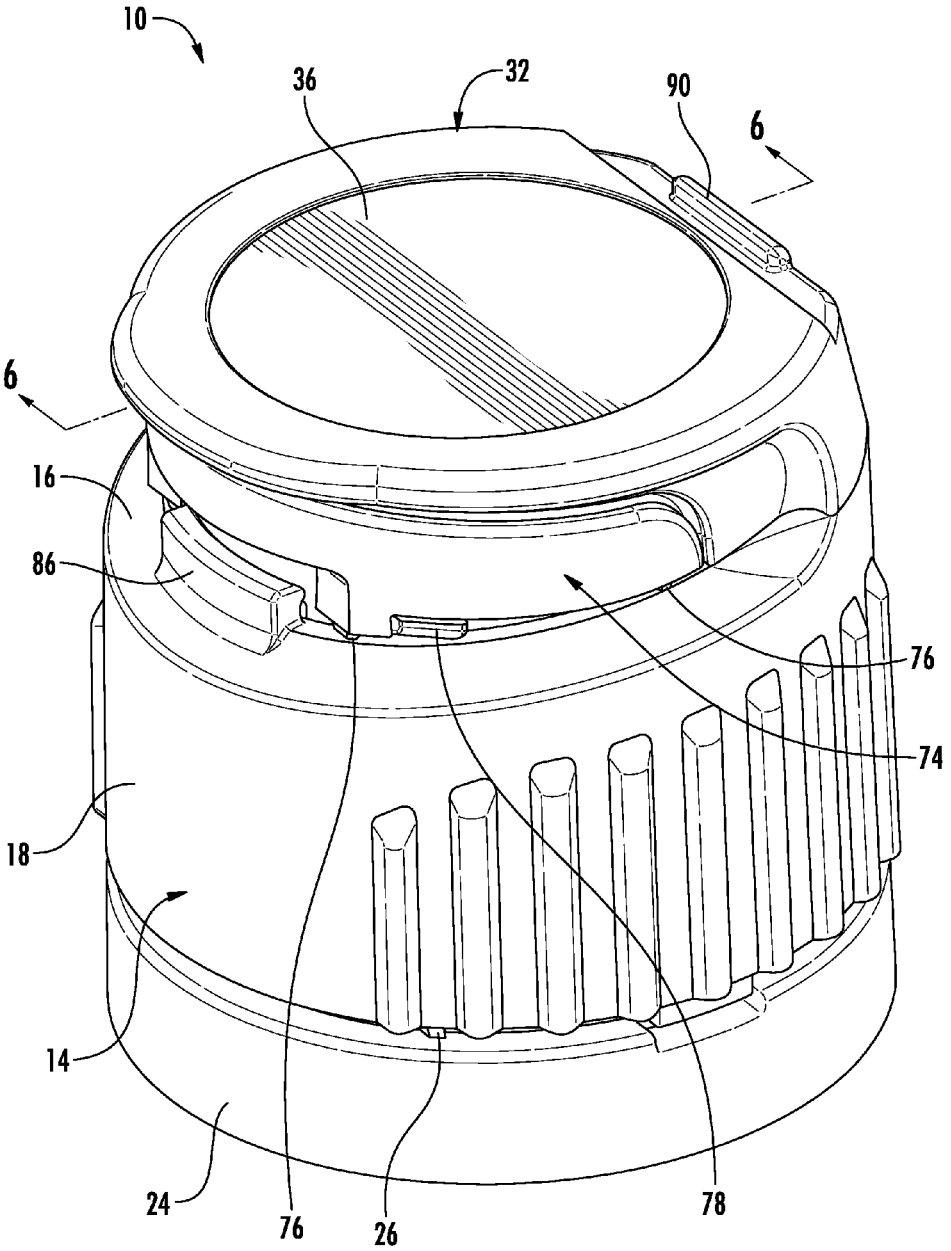
FIG. 1 is a perspective view of an exemplary embodiment of a tamper evident drop dispensing closure in accordance with the present invention.
Figure 2:
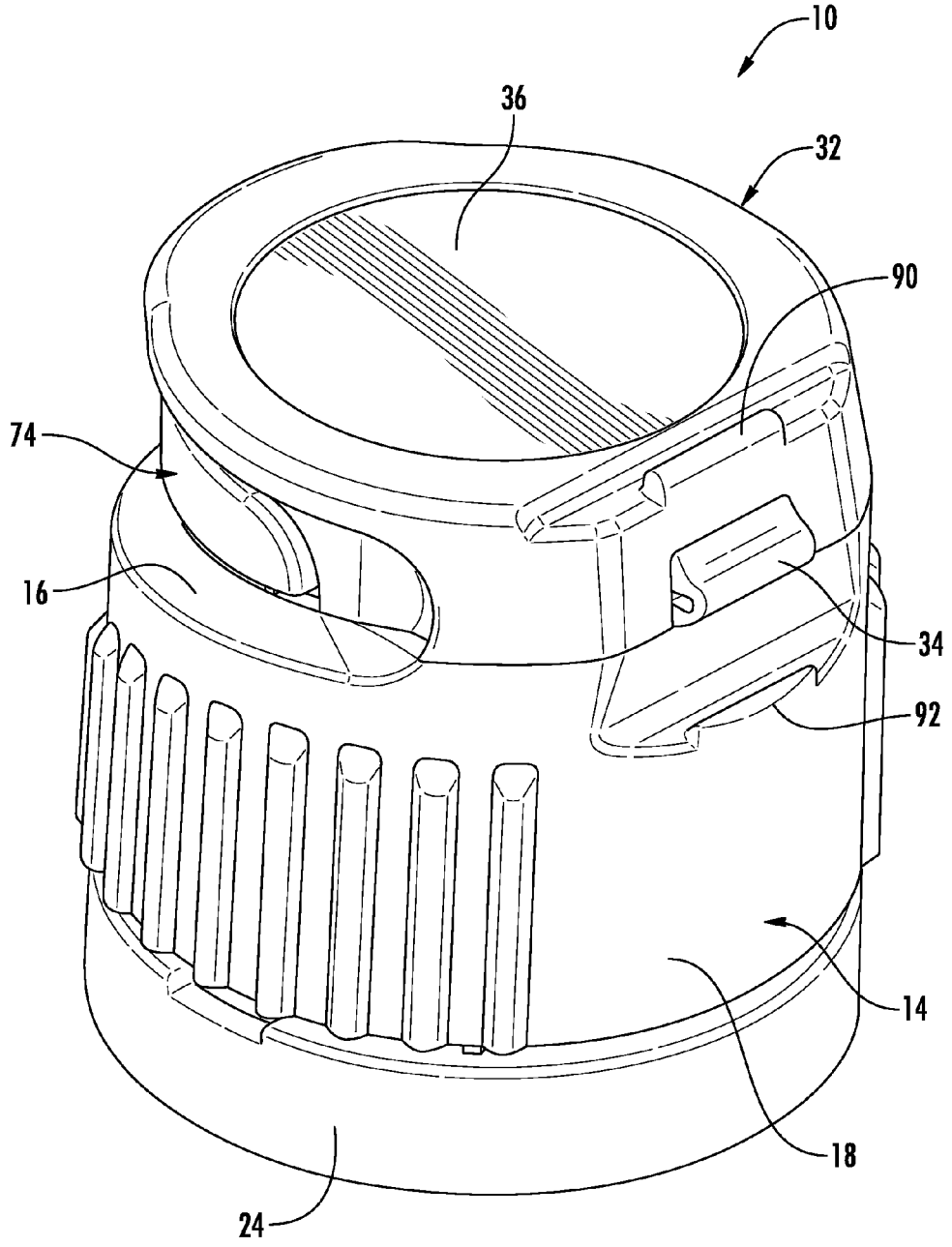
FIG. 2 is another perspective view thereof.
Figure 3:
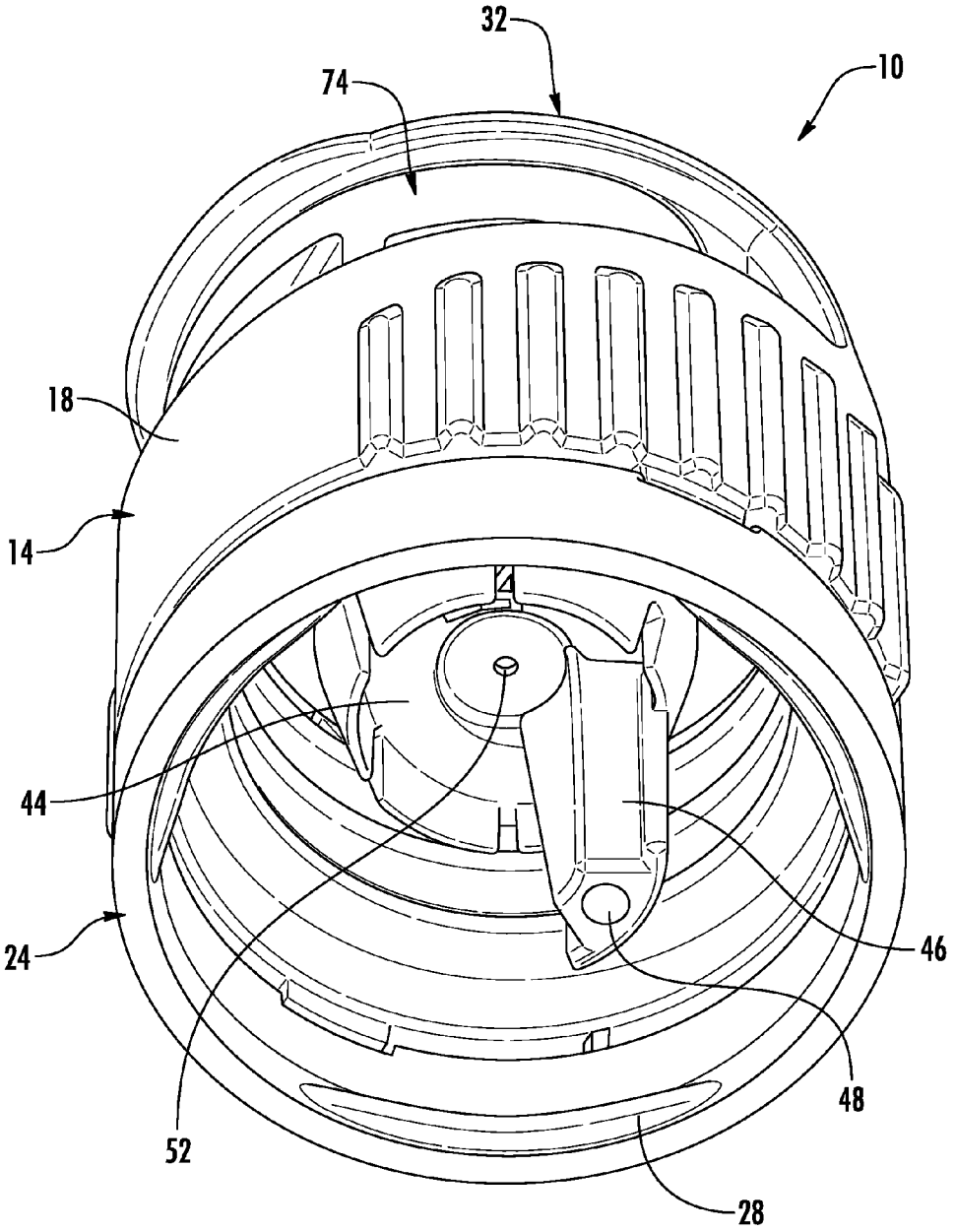
FIG. 3 is yet another perspective view thereof from below.
Figure 4:
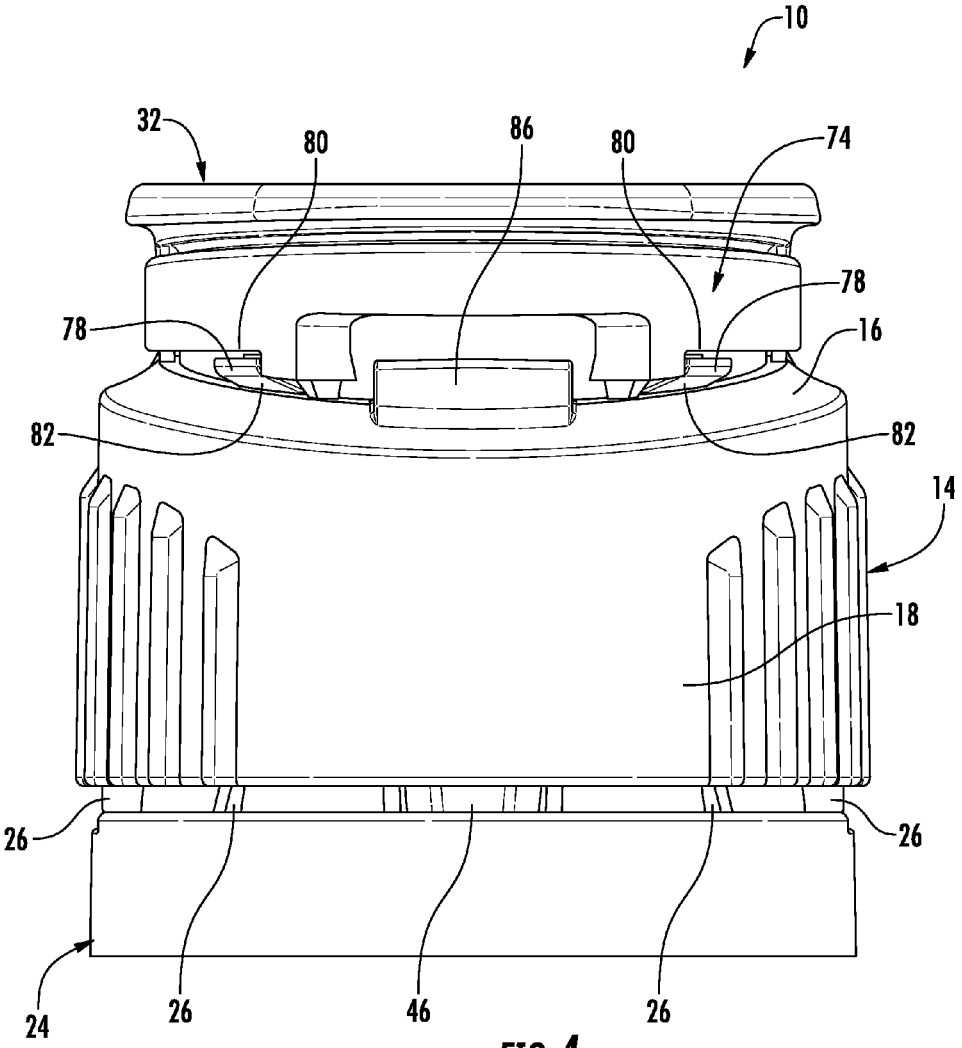
FIG. 4 is a front view thereof.
Figure 5:
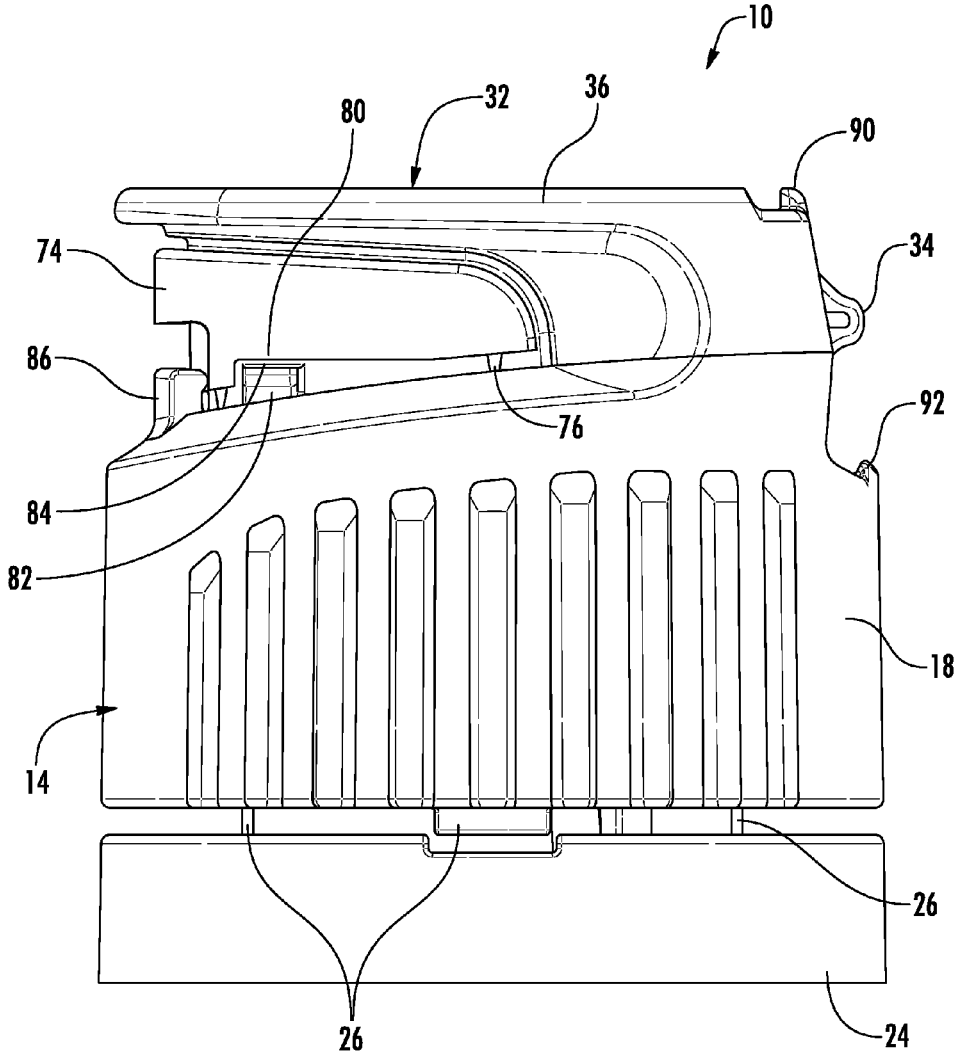
FIG. 5 is a right side view thereof.

An arcuate tamper-evident tear strip 74 is integrally formed with the closure deck 16 where the tear strip 74 is connected to the closure deck 16 by a plurality of frangible elements 76 extending between a lower edge of the tear strip 74 and the closure deck 16. The tear strip 74 is selectively detachable from the closure deck 16 by breaking of the frangible elements 76. At least one locking tab 78 is formed on an outer surface of the cap 32 wherein the locking tab 78 is positioned to engage a shoulder 80 formed on a lower edge on the tear strip 74 when the cap 32 is in the closed position. In the exemplary embodiment, a spaced pair of locking tabs 78 extends from the front of the cap 32 to provide a distributed lifting force against the tear strip 74. Either prior to or during the capping operation, the cap 32 is moved from the open, as molded position (FIG. 7) to the closed position (FIG. 1). In this regard, the locking tabs 78 have a tapered surface 82 that slides behind the tear strip 74 and a sharp ledge surface 84 which seats itself beneath the lower shoulder edge 80. In use, the locking tab 78 and the shoulder 80 cooperate to prevent the cap 32 from being moved from the closed position to the open position without detaching the tear strip 74 from the closure deck 16. Premature lifting cap 32 prior to purchase or intended use will sever the frangible elements 76 clearly indicating tampering with the product. It is noted that the frangible elements 76 are sufficiently spaced apart from each other and from the locking tabs 78 so that the tear strip 74 separates from the cap 32 once the cap is lifted.

At the front of the closure body 14 there is further provided a snap ledge 86 which engages with a snap bead 88 formed on the lower peripheral edge of the front of the cap 32. This snap formation firmly holds the front of the cap 32 in a closed position both before and after the tear strip 74 is severed and removed.

Figure 10:
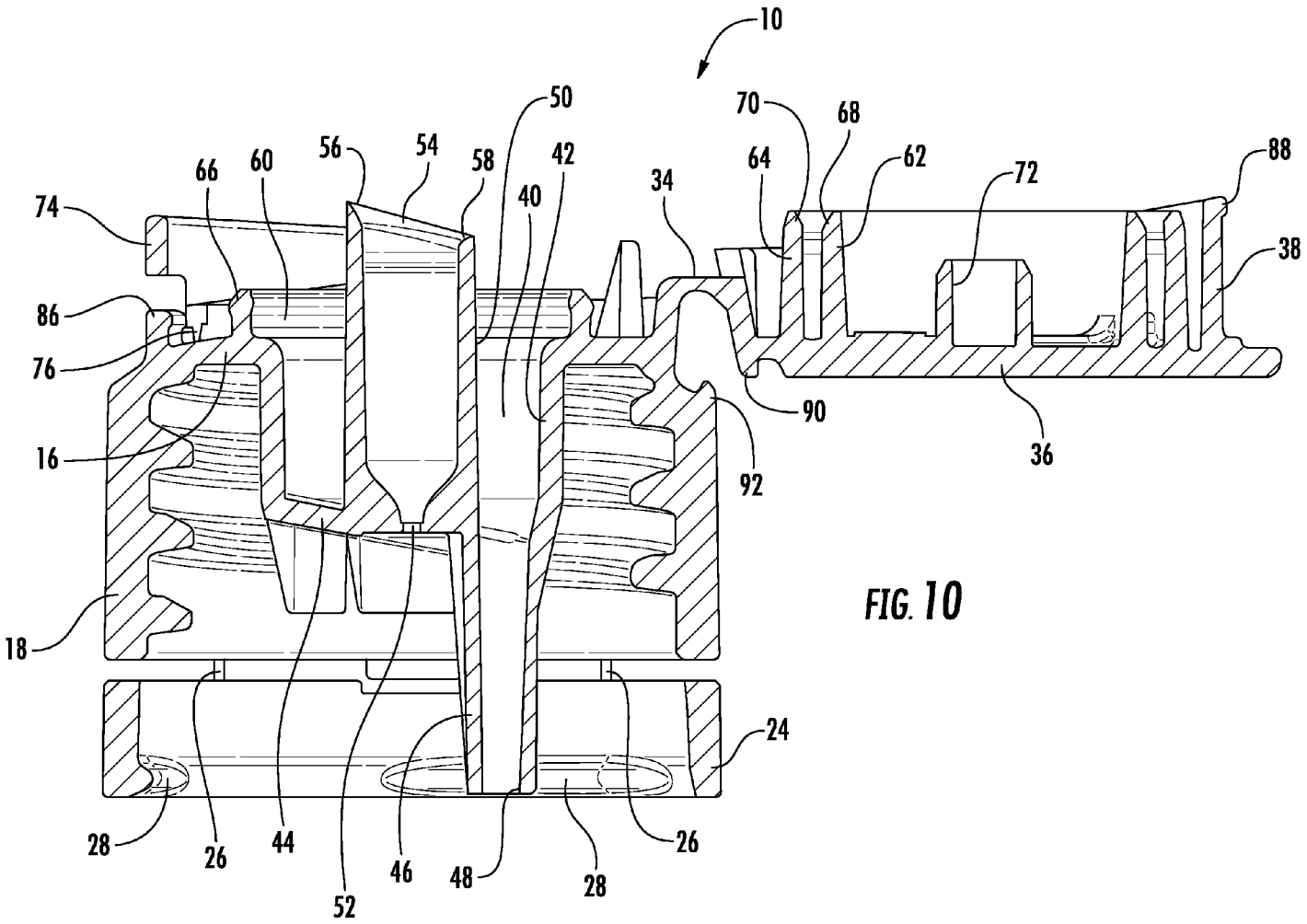
FIG. 10 is a cross-sectional view thereof taken along line 10-10 of FIG. 9.
Figure 11:
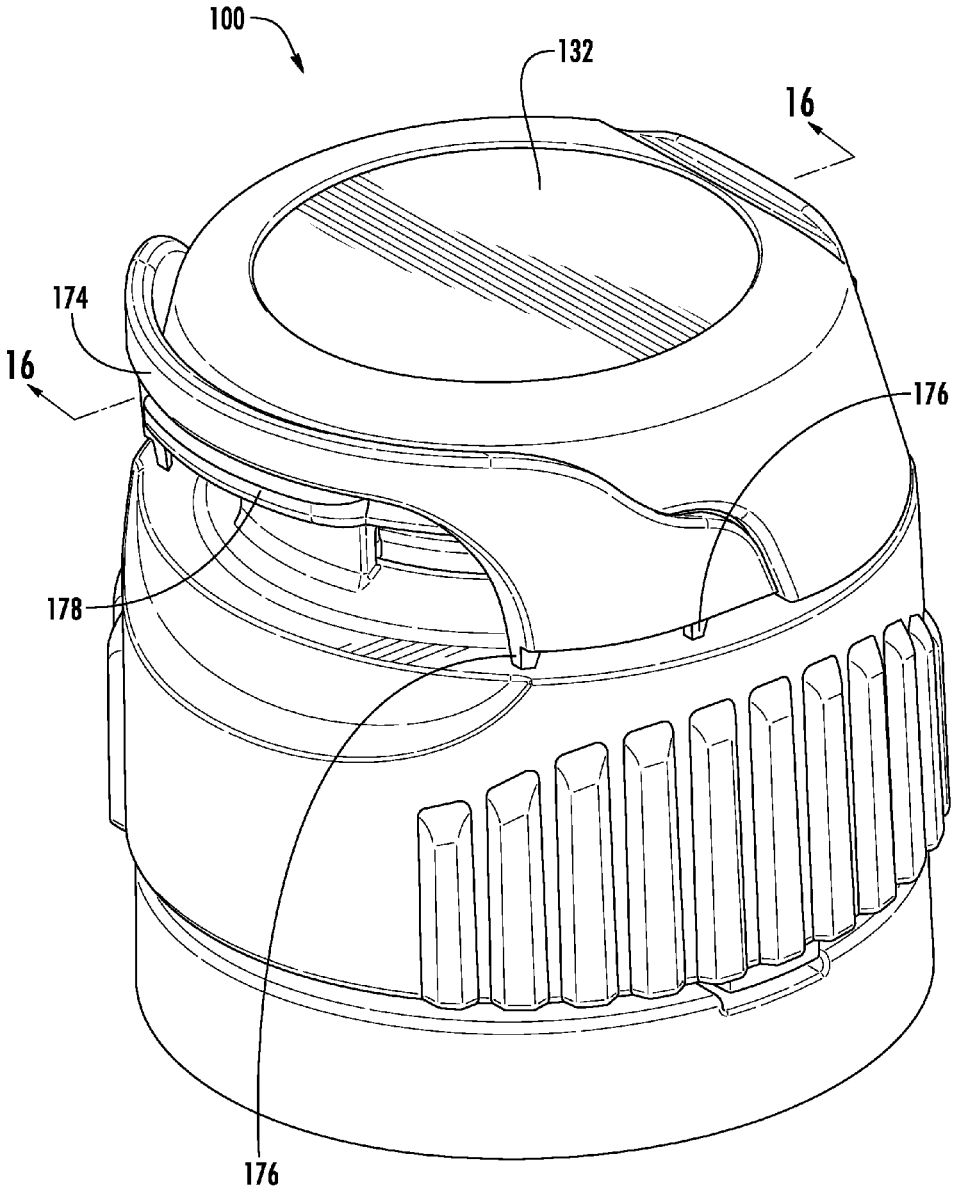
FIG. 11 is a perspective view of another exemplary embodiment with an alternative tamper evident closure system.
Figure 12:
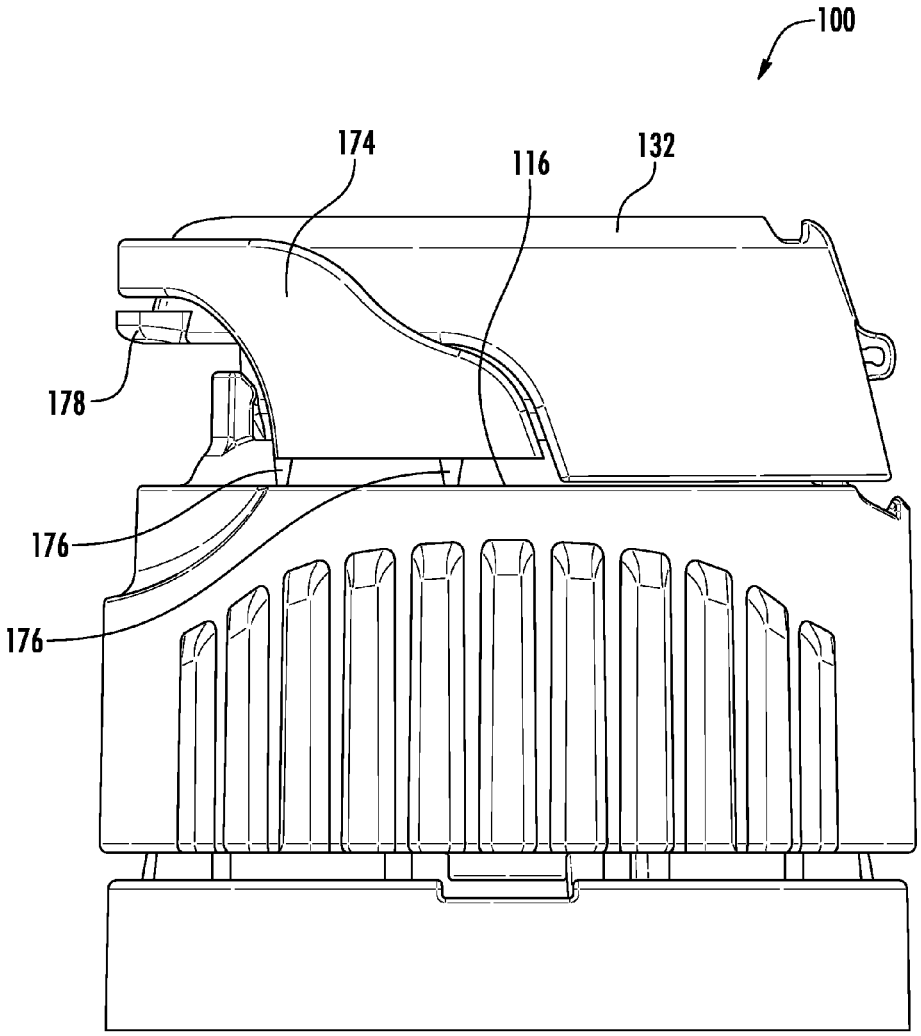
FIG. 12 is a side view thereof.
Figure 13:
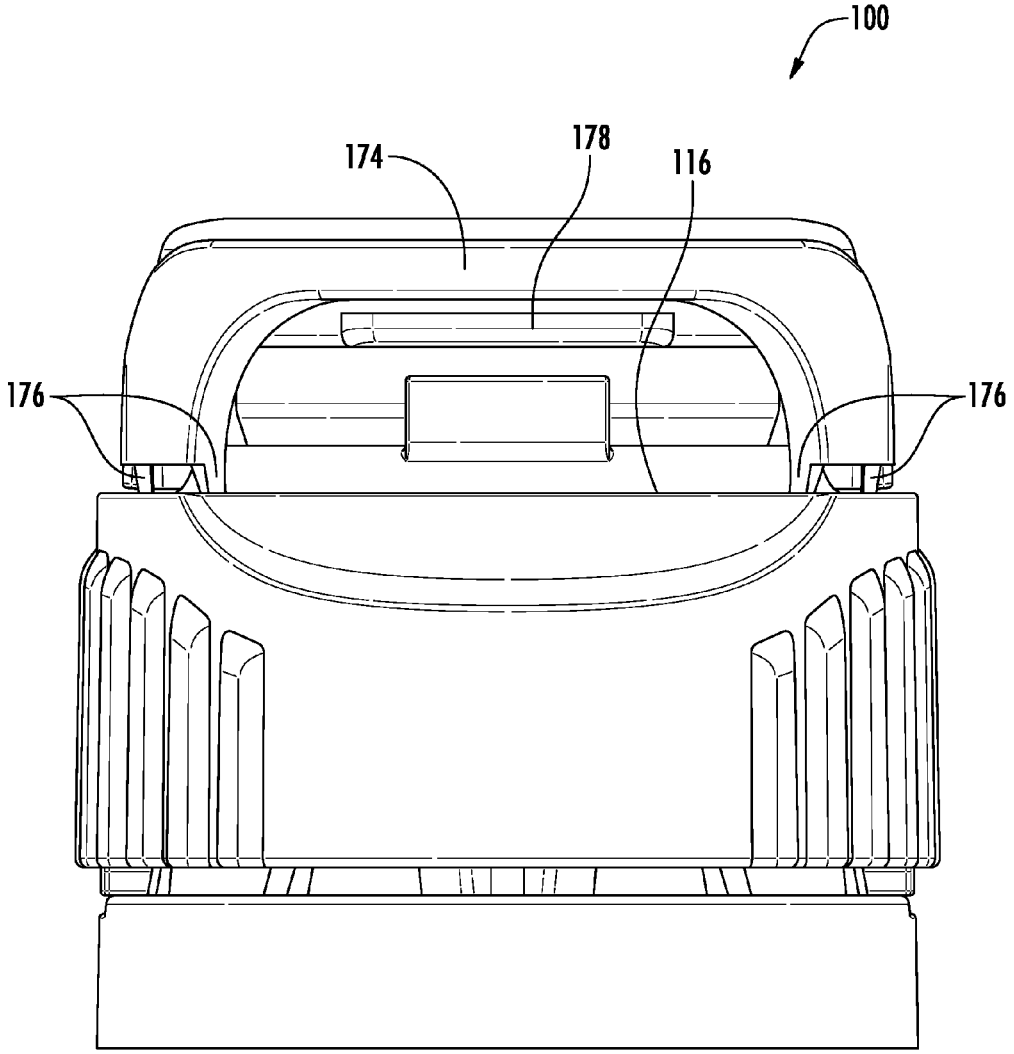
FIG. 13 is a front view thereof.

To selectively maintain the cap 32 in an open position during dispensing, a first flexible latch protrusion 90 is provided on the upper wall 36 of the cap 32 above the living hinge 34, and a second flexible latch protrusion 92 is provided on an outer surface of the closure body 14 below the living hinge 34. Referring to FIG. 10, it can be appreciated that when the cap 32 is moved past the as molded horizontal position, the latch protrusions 90, 92 are configured to snap past one another and maintain the cap 32 in a fully open position.

Figure 14:
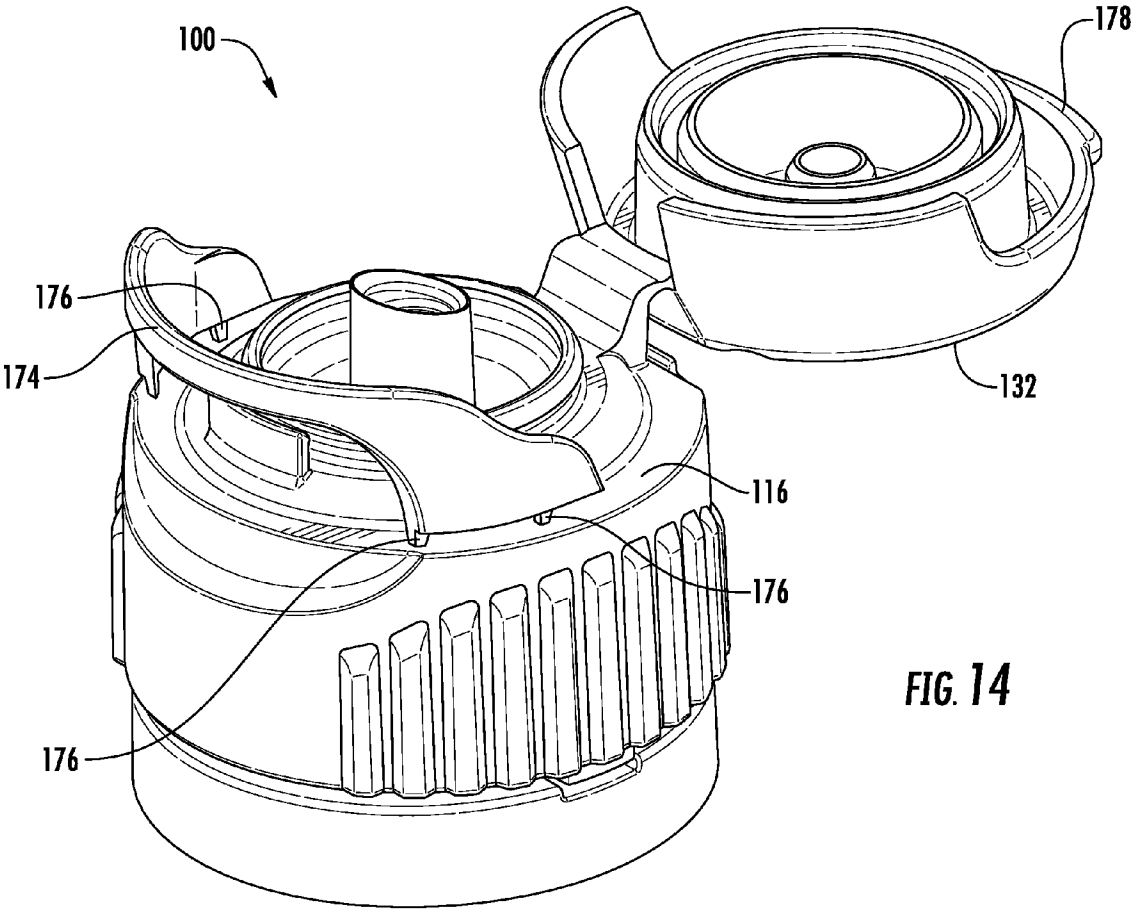
FIG. 14 is a perspective view thereof in an open, as-molded condition.
Figure 15:
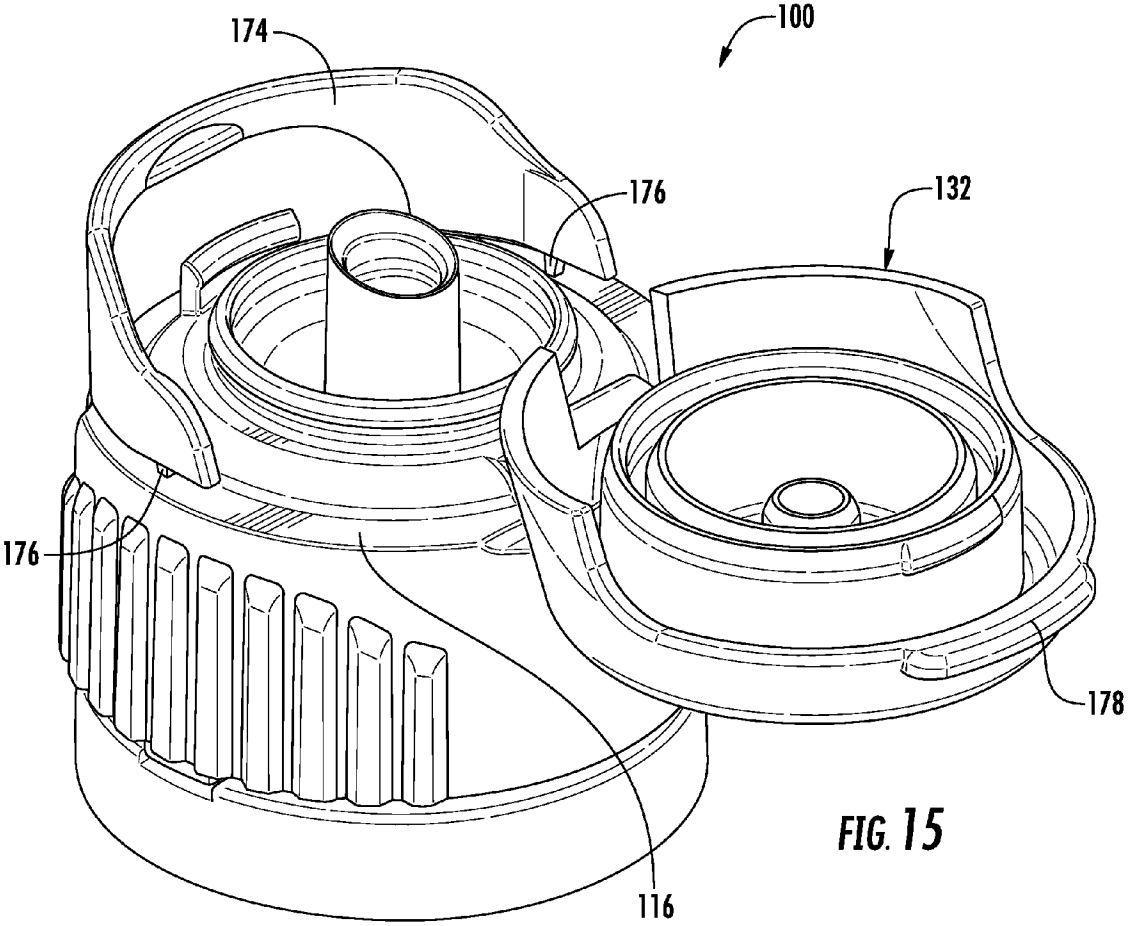
FIG. 15 is another perspective view thereof in an open, as-molded condition.
Figure 16:
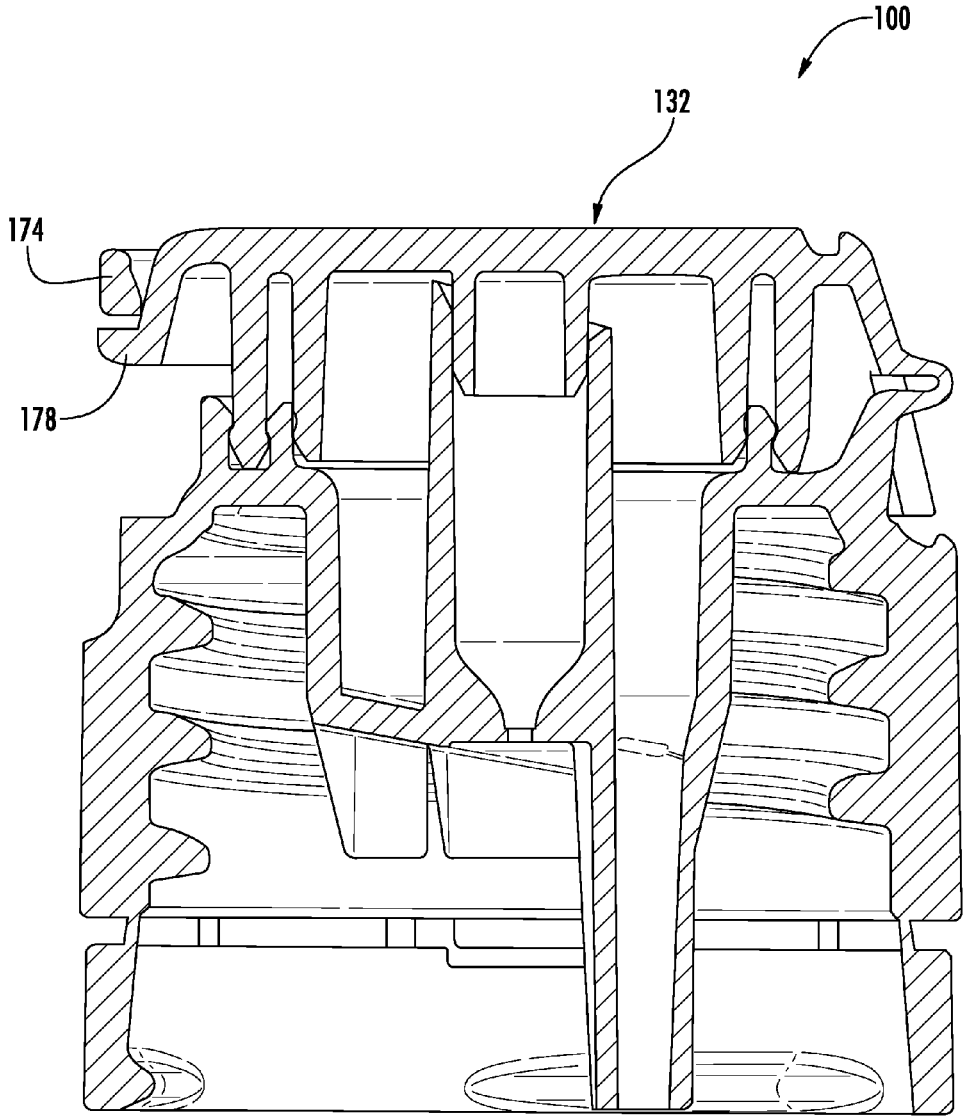
FIG. 16 is a cross-sectional view thereof taken along line 16-16 of FIG. 11.

Other embodiments of the invention may include a single centered locking tab that engages a modified tear strip without departing from the scope of the present invention. In this regard, turning to FIGS. 11-16, an alternate embodiment of the closure is illustrated and generally indicated at 100. The closure 100 has all of the same features and attributes as the first embodiment with the exception of the shape appearance of the tamper evident tear strip 174 and the locking tab 178. As best seen in FIGS. 14 and 15, the tear strip 174 is generally an inverted U-shape where the lower peripheral edges of the opposed legs are connected to the closure deck 116 by means of a plurality of frangible elements 176. The central body of the tear strip 174 extends across the front of the closure 100 and provides a central shoulder for engagement with a single elongated locking tab 178 which extends forwardly from the front of the cap 132. Use and capping operations are the same as previously described.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A one-piece drop dispensing closure comprising:
- a closure body having a closure deck and a skirt portion arranged to secure to a neck of a container,
- a cap connected to said closure body,
- a drainback recess within said closure deck,
- a vent tube depending downwardly from a bottom wall of said drainback recess, said vent tube having a vent opening at a bottom end thereof,
- a tubular spout extending upwardly from said bottom wall, the spout including a drop dispensing orifice,
- a tear strip connected to said closure deck; and
- a locking tab on said cap engaging said tear strip,
- said spout having a drip lip with a leading edge and a trailing edge,
- said drip lip being downwardly angled from the leading edge thereof to the trailing edge thereof,
- said bottom wall of said drainback recess being downwardly sloped from the leading edge of said drip lip to the trailing edge thereof.

2. The closure of claim 1 wherein said vent tube has a predetermined length which does not extend beyond a lower peripheral edge of said skirt portion.

3. The closure of claim 2 wherein said vent tube is located on the trailing edge side of said drip lip.

4. The closure of claim 2 wherein said vent opening has a predetermined diameter and said drop dispensing orifice has a predetermined diameter.

5. The closure of claim 4 wherein said dispensing orifice diameter is in a range from about 0.015 inch to about 0.035 inch, said vent opening diameter is in a range from about 0.040 inch to about 0.080 inch and the vent tube length is in a range from about 0.444 inch to about 0.864 inch.

6. The closure of claim 2 wherein the vent tube length is in a range from about 0.444 inch to about 0.864 inch.

7. The closure of claim 1 wherein said vent tube is located on the trailing edge side of said drip lip.

8. The closure of claim 1 wherein said vent opening has a predetermined diameter and said drop dispensing orifice has a predetermined diameter.

9. The closure of claim 1 wherein said drainback recess has an outer surface contoured to be received in frictional sealing engagement with an inner surface of the neck of said container.

10. The closure of claim 1 further comprising a tamper-evident skirt ring connected to a lower peripheral edge of said skirt portion by a plurality of frangible security elements.

11. The closure of claim 1 wherein said leading edge of said drip lip has an acute edge angle of less than 45 degrees.

12. The closure of claim 1 further comprising:
- a first flexible latch protrusion on said cap, and
- a second flexible latch protrusion on an outer surface of said closure body.

13. The closure of claim 1 wherein said tear strip comprises an arcuate tamper-evident tear strip integrally formed with said closure deck and connected to said closure deck by a plurality of frangible elements; and
- wherein said locking tab comprises at least one locking tab on said cap which engages said tear strip.

14. A one-piece drop dispensing closure comprising:
- a closure body having a closure deck and a skirt portion arranged to secure to a neck of a container,
- a cap connected to said closure body,
- a drainback recess within said closure deck,
- a vent tube depending downwardly from a bottom wall of said drainback recess, said vent tube having a vent opening at a bottom end thereof,
- a tubular spout extending upwardly from said bottom wall, the spout including a drop dispensing orifice,
- said spout having a drip lip with a leading edge and a trailing edge,
- said drip lip being downwardly angled from the leading edge thereof to the trailing edge thereof,
- said bottom wall of said drainback recess being downwardly sloped from the leading edge of said drip lip to the trailing edge thereof, and
- wherein a predetermined diameter of said dispensing orifice and said vent opening and a predetermined length of said vent tube length are selected to create a predetermined drop size and drop rate depending on a viscosity of a fluid to be dispensed.

15. The closure of claim 14 wherein said dispensing orifice diameter is in a range from about 0.015 inch to about 0.035 inch.

16. The closure of claim 15 wherein said vent opening diameter is in a range from about 0.040 inch to about 0.080 inch.

17. The closure of claim 14 wherein said vent opening diameter is in a range from about 0.040 inch to about 0.080 inch.

18. The closure of claim 17 wherein the vent tube length is in a range from about 0.444 inch to about 0.864 inch.

19. A one-piece drop dispensing closure comprising:

a closure body having a closure deck and a skirt portion arranged to secure to a neck of a container, a cap connected to said closure body, a drainback recess within said closure deck, a vent tube depending downwardly from a bottom wall of said drainback recess, said vent tube having a vent opening at a bottom end thereof, a tubular spout extending upwardly from said bottom wall, the spout including a drop dispensing orifice, said spout having a drip lip with a leading edge and a trailing edge, said drip lip being downwardly angled from the leading edge thereof to the trailing edge thereof, said bottom wall of said drainback recess being downwardly sloped from the leading edge of said drip lip to the trailing edge thereof, said closure further comprising an annular sealing lip encircling said drain back recess, said cap including sealing walls engaging with said annular sealing lip.

20. The closure of claim 19 wherein said cap further includes a plug seal engaging with said spout to form a seal.

* * * * *